United States Patent [19]

Hall

[11] 4,149,545

[45] Apr. 17, 1979

[54] CIGARETTE MAKING AND PACKING SYSTEM

[75] Inventor: Floyd V. Hall, Durham, N.C.

[73] Assignee: Liggett Group Inc., Durham, N.C.

[21] Appl. No.: 765,594

[22] Filed: Feb. 4, 1977

[51] Int. Cl.[2] ..... A24C 5/35; A01F 25/00; B65G 63/30; G07F 11/00

[52] U.S. Cl. ..... 131/25; 131/20 R; 131/21 R; 131/21 A; 131/21 C; 198/347; 198/601; 221/10; 414/294

[58] Field of Search ..... 53/59 R, 48; 214/17 CA; 198/347, 601, 568, 448; 131/20 R, 20 A, 21 R, 25, 21 A, 21 C; 221/10, 11, 13, 14, 15, 17, 18, 92, 95, 104, 106, 175, 206, 207–209; 222/76

[56] References Cited

U.S. PATENT DOCUMENTS

| | | | |
|---|---|---|---|
| 3,885,683 | 5/1975 | Bornfelth et al. | 214/17 CA |
| 4,023,669 | 5/1977 | Clarke | 198/347 |
| 4,056,916 | 11/1977 | Seragnoli | 53/59 R |

*Primary Examiner*—Robert W. Michell
*Assistant Examiner*—V. Millin
*Attorney, Agent, or Firm*—J. Bowen Ross, Jr.; Michael L. Hendershot

[57] ABSTRACT

Two cigarette making machines are interconnected to a single cigarette packing machine via a transfer system which uses individual conveyors to convey the cigarettes from each making machine to a single chute leading to the packing machine. The flow of cigarettes into the chute from the two conveyors is controlled by a series of switches which are activated in response to the amount of stored cigarettes in the storage of the transfer system as well as a photocell arranged above the mouth of the chute. These switches actuate a control to slow down or speed up the packer in response to the amount of stored cigarettes while the photocell controls the operation of the conveyors of the transfer system in response to the absence or presence of cigarettes at the position of the photocell.

8 Claims, 5 Drawing Figures

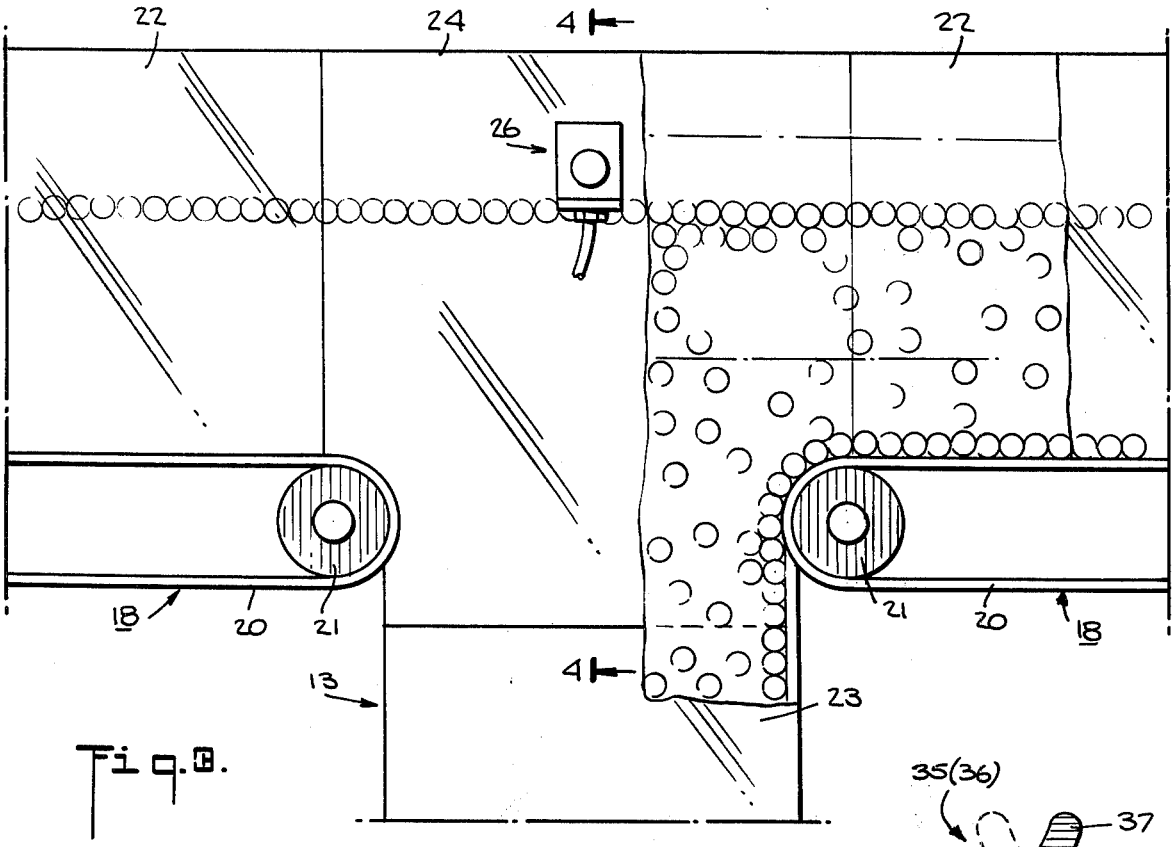
Fig. 3.
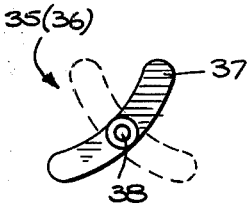
Fig. 5.
Fig. 4.
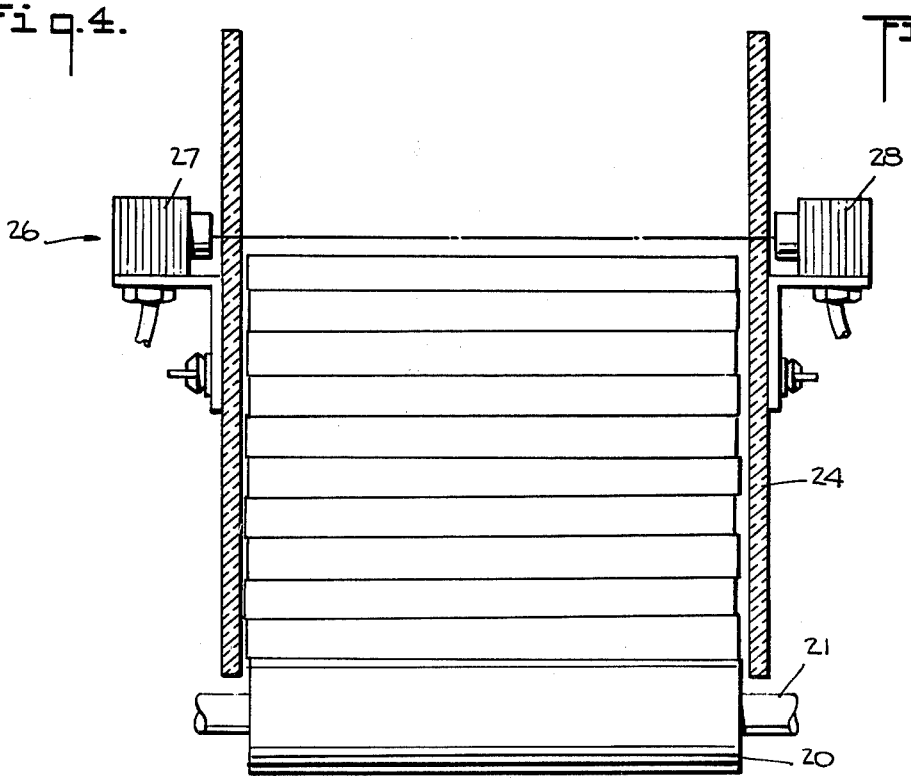

CIGARETTE MAKING AND PACKING SYSTEM

This invention relates to a cigarette making and packing system. More particularly, this invention relates to a system which includes two cigarette making machines and a single cigarette packing machine.

As is known, various efforts have been made to make and package cigarettes at high output in order to obtain economies in cigarette manufacture. To this end, cigarette making and cigarette packing machines have been constructed to obtain maximum outputs. In addition, these machines have been interconnected with each other so as to have the cigarettes made on a making machine automatically conveyed directly from the citarette making machine to a cigarette packing machine on a one-to-one basis, for example as described in U.S. Pat. No. 3,799,324. Up until the present time, the known cigarette making machines have been able to operate at speeds of 3600 cigarettes per minute or more, for example, up to about 5,000 per minute. However, packing machines have been capable of packing cigarettes at much higher rates, for example, at rates of about 400 packs per minute (i.e. 8000 cigarettes per minute). Thus, where a single making machine is connected to such a high speed packing machine, the packing machine does not operate at maximum speed.

In order to maximize the use of a high speed packing machine, attempts have been made to use two cigarette machines for each packing machine. In these cases, various transfer systems have been used to convey the cigarettes to the packing machines. However, these transfer systems are usually rather complicated and expensive. For example, one such transfer system requires two cigarette making machines to feed a storage unit which thereafter feeds one packing machine.

Accordingly, it is an object of the invention to provide a system wherein two cigarette making machines are able to feed a single packing machine in a simple and relatively economical manner.

It is another object of the invention to provide a system wherein two cigarette making machines feed a supply of cigarettes directly to a packing machine.

It is another object of the invention to provide a system for maximizing the output of cigarette making machines and a cigarette packing machine.

Briefly, the invention provides a combination of a pair of cigarette making machines for making and supplying cigarettes and a cigarette packing machine for packing cigarettes at a variable rate. The combination further includes a transfer system for delivering the cigarettes from the making machines to the packing machine and a control means for varying the packing rate of the packing machine.

The packing machine is operated, for example at a reduced half-speed (200 packs per minute) or at full speed (400 packs per minute) and has a chute to receive the cigarettes. In addition, the transfer system includes two conveyors, each of which extends from one of the making machines to the chute of the packing machine in order to deliver cigarettes to the packing machine, as well as two storage means, each of which communicates with a respective making machine and a respective conveyor for selectively storing cigarettes delivered from the making machine and feeding the stored cigarettes to the conveyor.

In addition, the combination includes a series of switches which are responsive to predetermined accumulations of cigarettes in each of the storage means and which are connected to the control means of the packing machine to activate the control means to operate the packing machine at one of the operating speeds. Also, a photocell is positioned at a set position vertically above the chute of the packing machine in order to detect the absence or presence of cigarettes at the level of the photocell. This photocell is operatively connected to each of the conveyors of the transfer system in order to deactivate the conveyors in response to the presence of cigarettes at the set position and to activate the conveyors in response to the absence of cigarettes at the set position during operation of the packing machine.

Each series of switches also includes a terminal switch which is responsive to the absence of cigarettes in a respective storage means. Each terminal switch is connected to the control means of the packing machine in order to deactivate the control means to stop the packing machine when both terminal switches are activated. The photocell is also connected with each terminal switch to activate a respective conveyor only if the respective terminal switch associated with that conveyor is deactivated so as to allow operation of the packing machine.

During operation, the cigarette making machines supply a stream of cigarettes to a respective conveyor of the transfer system. These conveyors, in turn, deliver the cigarettes directly into the chute of the packing machine. Any excess cigarettes which are delivered from the making machines are accumulated within the respective storage means of each transfer system.

In the event that too many cigarettes are delivered into the chute of the packing machine, a pile up of cigarettes will occur above the chute up to the position of the photocell. The photocell then responds by shutting off the two conveyors. As the level of cigarettes above the chute thereafter drops below the photocell, the conveyors are again activated to deliver further cigarettes.

In the event that the storage means are being emptied of stored cigarettes, the first switch of a series is activated, for example when there are virtually no cigarettes in the associated storage means. This switch, in turn, signals the control means to change the speed of the packing machine to the reduced half speed. Should both storage means become completely emptied, the terminal switches associated with each storage means are activated. This, in turn, causes the control means to stop the packing machine. At this time, the cigarettes accumulate above the chute and the photocell, in sensing this condition, stops the conveyors of the transfer system. As the storage means receive more cigarettes from the respective making machines, the terminal switches return to their normal position. The packing machine is then activated by the control means to operate at half speed. As the level of cigarettes then drops above the chute, the photocell activates the conveyors of the transfer system to deliver a continuous supply of cigarettes to the packing machine. As the cigarettes accumulated in the storage means increase to some predetermined reserve capacity, a second switch of each series is activated to activate the control means to operate the packing machine at full speed. This second switch is positioned upstream of the first switch of the series relative to the chute of the packing machine. The reason for this particular arrangement is that if the transfer system were not provided with the second switches, the first switches would be constantly jogging the packing machine by increasing and decreasing the speed causing undue wear in the packing machine. Therefore, both storage means must contain a substantial quantity of cigarettes in order for the packing machine to operate at full speed. Also, once receiving such a quantity, the packing machine will continue to operate at a substantial period of time without any cigarettes being supplied to the system by the making machines.

These and other objects and advantages of the invention will become more apparent from the following detailed description and appended claims taken in conjunction with the accompanying drawings in which:

FIG. 3 illustrates an enlarged view of the upper end of a chute and the terminal ends of the conveyors of a transfer system in accordance with the invention;

FIG. 4 illustrates a view taken on line 4—4 of FIG. 3; and

FIG. 5 illustrates a view of a switch used in accordance with the invention.

Figure 1:
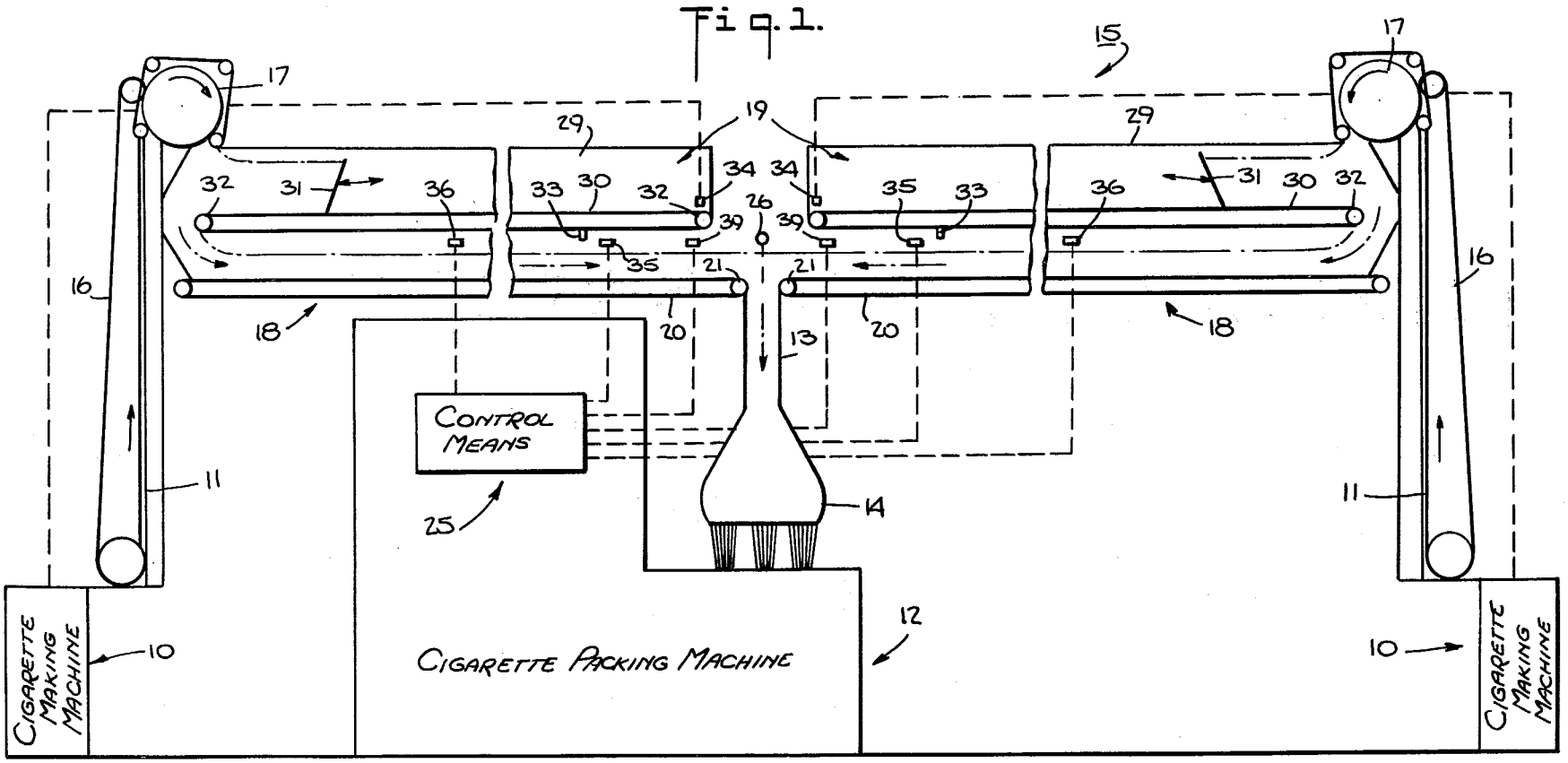
FIG. 1 illustrates a perspective view of a system of cigarette making machines and packing machines according to the invention.

Referring to FIG. 1, a pair of cigarette making machines 10 of suitable construction are located at spaced apart locations for making and supplying cigarettes 11 to a cigarette packing machine 12 of known construction. As shown, the packing machine 12 has a vertical chute 13 to receive cigarettes. This chute 13 terminates at the lower end in a separation and delivery means 14 of conventional structure which delivers the cigarettes to the packing machine proper.

A transfer system 15 interconnects the two making machines 10 to the packing machine 12 in order to convey the cigarettes 11 supplied by the making machines 10 to the packing machine 12. To this end, the transfer system includes a pair of vertical conveyors 16 each of which is associated with a respective cigarette making machine 10 in order to convey a stream of cigarettes from the respective making machines 10 upwardly in single file array. In addition, a transfer drum system 17 is disposed atop each vertical conveyor 16 to deliver the stream of cigarettes 11 to a horizontal conveyor 18. The two horizontal conveyors 18 are of the same construction and are disposed in mirror image (i.e., opposite) to each other. In addition, each conveyor 18 cooperates with a storage means 19 which communicates with a making machine 10 and a conveyor 18 for selectively storing cigarettes delivered from the making machine 10 and to feed the stored cigarettes to the conveyor 18. The construction of the conveyor 18, transfer drum system 17 and storage means 19 are further described in U.S. Pat. No. 3,799,324 as well as U.S. Pat. No. 3,878,852.

As shown in FIG. 3, the horizontal conveyors 18 each extend from a respective cigarette making machine 10 to the chute 13 to convey a stream of stacked cigarettes to the mouth of the chute 13. Also, each conveyor 18 is disposed opposite the other at the mouth of the chute 18 and is driven by an independent motor (not shown) independently of the vertical conveyors 16 and the storing means 19.

Referring to FIGS. 3 and 4, each conveyor 18 has an endless conveyor belt 20 which is driven around roller 21 located adjacent to the mouth of the chute 13. In addition, each conveyor 18 has a pair of transparent sidewalls 22 which extend upwardly from the conveyor belt 20 to permit conveyance of a stacked layer of cigarettes. The chute 18 is likewise bounded by a pair of transparent side walls 23 to retain the cigarettes within the chute 18. These side walls 23 extend to about the level of the mouth of the chute 18. In addition, a pair of transparent side walls 24 are disposed to opposite sides of the transfer system 15 with each located between a conveyor side wall 22 and a chute side wall 23 so as to form a continuous wall relative to the flow of cigarettes.

A suitable control means 25 is provided, for example within the packing machine 12, for varying the packing rate of the packing machine 12. For example, where the packing machine 12 is operable at one of two selected packing rates, e.g., a full speed of 400 packs per minute and a reduced half-speed of 200 packs per minute, the control means 25 includes switches for switching the packing machine 12 to any one of the two rates. As such is conventional structure, no further description is required.

Figure 2:
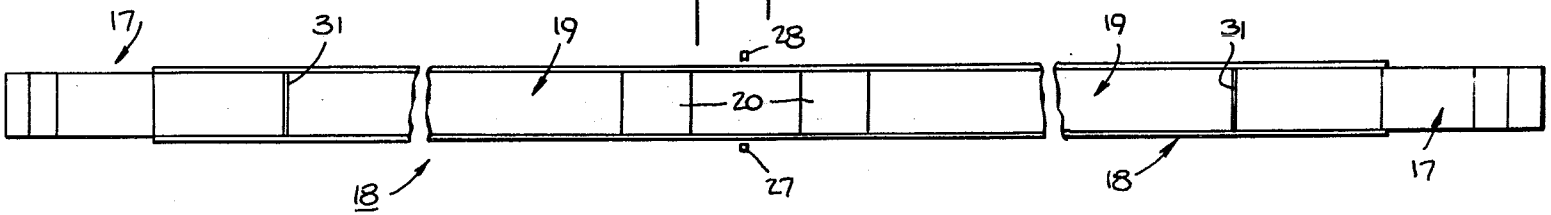
FIG. 2 illustrates a stop view of the horizontal conveyors of the transfer system according to the invention.

Referring to FIGS. 1 to 3, a photocell 26 is located above and in the projected vertical plane of the mouth of the chute 13. This photocell 26 is disposed in a set position slightly above the level of the cigarettes normally delivered to the packing machine chute 13 so as to sense the presence or absence of cigarettes at this position. As shown in FIGS. 3 and 4, the components of the photocell 26 are mounted on the transparent side walls 24 between the sidewalls 22, 23 of the conveyors 18 and chute 13, respectively. The photocell 26 is of conventional structure and includes a light emitter 27 mounted on one side wall 24 to emit a beam of light and a light receiver 28 mounted on the opposite side wall 24 to receive the beam of light. As indicated, the emitter 25 and receiver 26 are adjustably mounted on the side walls 23.

As shown in FIG. 1, the photocell 26 is connected to the conveyors 18 of the transfer system 15, i.e., to the motors (not shown) which drive the conveyors 18 in a suitable fashion so as to activate or deactivate the conveyors 18. For example, the photocell 26 is responsive to the presence of cigarettes at the position of the photocell 26 (i.e., when the light beam is blocked from the receiver 28) so as to deactivate the conveyors 18 so that no further cigarettes are fed to the packing machine 12. The photocell 26 is also responsive to the absence of cigarettes at the position of the photocell 26 (i.e., when the light beam falls on the receiver 28) so as to activate the conveyors 18 to resume delivery of cigarettes to the packing machine 12.

Referring to FIG. 1, each storage means 19 includes an elongated reservoir 29 of generally trough-shape construction. The reservoir 29 has a horizontally disposed endless conveyor belt 30 which forms a floor of the reservoir 29 in order to receive a stacked array of cigarettes from the transfer drum system 17. In addition, a wall 31 is secured to the conveyor belt 30 to move with the belt 30 from a position adjacent the end of the reservoir 29 near the transfer drum 17 to the opposite end of the reservoir 29. The belt 30 is disposed about suitable rollers 32, one of which is driven by a suitable motor (not shown). In addition, a rod 33 is secured to the belt 30 on the underside of the floor to move in a predetermined path in response to movement of the belt 30. The rod 33 is positioned relative to the wall 31 such that when the wall 31 is at the end of the reservoir 29 adjacent to the transfer drum 17, the rod 33 is adjacent to the free end of the storage means 19.

A switch 34 is positioned at the end of the reservoir 29 to be activated by the wall 31 in response to a complete filling of the storage means 19. This switch 33 is connected to the respective making machine 10 so as to deactivate the making machine in response to filling of the storage means 19.

As shown in FIG. 1, a series of switches are positioned below the reservoirs 29 of each storage means 19. These switches are responsive to predetermined accumulations of cigarettes in each storage means 19 and each is connected to the control means 25 of the packing machine 12 to activate the control means 25 to operate the packing machine 12 at one of two operating speeds. To this end, each series of switches includes two switches 35, 36 which are positioned in the path of the rod 33. One switch 35 is responsive to passage of the rod 33 during emptying of the respective reservoir 29 so as to activate the control means 25 to operate the packing machine 12 at a reduced speed, i.e., at half speed. The second switch 36 is responsive to passage of the rod 33 during filling of the respective reservoir 29 in order to activate the control means 25 to operate the packing machine 12 at full speed. As shown, the second switch 36 is disposed upstream of the switch 35 relative to the chute 13 of the packing machine 12.

Referring to FIG. 5, each of the switches 35, 36 is constructed in similar fashion. In this regard, each switch 35, 36 includes a trip bar 37 which is pivotable about a pin 38. The trip bar 37 of the upstream switch 36 is initially positioned for a full reservoir 29 in the position as shown. As the rod 33 passes by the trip bar 37, the bar is pivoted into the dotted line position shown in FIG. 5. At this time, however, the switch 36 does not activate the control means 25. Instead the switch 36 is moved into a ready state. The other switch 35 has a similar trip bar 37; however, when the rod 33 trips the bar 37 into the dotted line position as shown in FIG. 5, the control means 25 is activated so that the packing machine 12 is switched to half speed. When the rod 33 returns during filling of a reservoir 29, the switch 35 is flipped from the dotted line position as shown in FIG. 5 to the full line position as shown in FIG. 5. This, however, does not activate the control means 25. Instead, as the rod 33 moves past switch 36, the trip 37 is moved from the dotted line position to the full line position as shown in FIG. 5. This causes the control means 25 to be activated so that the packing machine 12 is then operated at full speed.

By positioning the two switches 35, 36 in spaced apart relation, the packing machine is not constantly switched back and forth between half speed and full speed for small variations in the amount of stored cigarettes in the storage means 19. Instead, the spacing of the switches 35, 36 from each other is such that both storage means must contain a substantial quantity of cigarettes in order for the packing machine 12 to operate at full speed. Once receiving such a quantity, the packing machine will continue to operate for a substantial period of time without any cigarettes being supplied to the transfer system by the cigarette making machines 10. In addition, the switches 35 are positioned at a point corresponding to an almost empty condition of the storage means 19.

Each series of switches also includes a terminal switch 39 which is positioned in the path of a respective rod 33 downstream of the switches 35, 36. Each terminal switch 39 is responsive to a respective rod 33 in order to activate the control means 25 to stop the packing machine 12 when the other terminal switch 39 is activated. That is, both terminal switches 39 must be closed before the packing machine 12 can be stopped.

In operation, cigarettes are conveyed from each of the cigarette making machines 10 at the full capacity of each machine along the conveyor belts 20 and are deposited from opposite sides into the mouth of the chute 13. The cigarettes then flow down the chute 13 under gravity into the packing machine 12. As indicated in FIG. 3, the cigarettes are conveyed along the conveyors 18 in stacked array up to a level above the respective conveyor belts 20. Generally, these levels are maintained during operation so that the output rate of the packing machine 12 is maximized. Further, the rate of cigarette making is usually slightly above the packing rate of the packing machine 12.

Referring to FIGS. 1 and 3, should the cigarettes be fed at a greater rate to the chute 13 than the packing rate of the packing machine 12, the cigarettes will pile up above the chute 13. As a result, the beam of light from the photocell transmitter 27 will be blocked from passage to the receiver 28. As a result, the photocell will emit a signal to the motors (not shown) of the conveyors 18 so that both conveyors 18 are stopped. The cigarettes can then fall down the chute to drop the level of cigarettes above the chute 13. At this time, the photocell becomes unblocked and a signal is emitted to the motors (not shown) of the conveyors 18 so that the conveyors 18 are again activated to deliver further cigarettes to the chute 13.

Assuming that the storage means 19 have been filled and that the making machines 10 are not delivering cigarettes or that the rate of feed is not high enough, the storage means 19 will empty. At this time, the wall 31 of each storage means will move towards the respective conveyor 16 and transfer drum 17 to empty the reservoirs 29. At the same time, the rod 33 will move past the switch 36 to place the switch in a ready state and then will move past the switch 35. Upon passage by the switch 35, the switch 35 will be activated and, in turn, will activate the control means 25 so that the packing machine is then run at half speed. Should the reservoirs 29 continue to empty, the rod 33 will move toward the terminal switch 39. As the reservoir 29 becomes empty, the switch 39 will become activated. If both terminal switches 39 are activated, these will, in turn, activate the control means 25 to stop the packing machine 12. At the same time, the conveyors 18 will continue to move cigarettes into the chute 13 so that a pile up of cigarettes in a chute causes the photocell 26 to deactivate the conveyors 18.

In order to resume operation, the making machines 10 must deliver cigarettes into the storage means 19 so as to cause the wall 31 to move in an expanding condition. At the same time, the rods 33 will move away from the terminal switches 39 so as to return the terminal switches 39 to a normally open state. The control means 25 can then switch the packing machine 12 into operation at half speed. Thereafter, as the cigarettes in the chute 13 are packed, the height of cigarettes above the chute will drop so that the photocell 26 becomes blocked. The conveyors 18 can then be activated. As the reservoirs 29 continue to fill, the rod 33 will move past the switches 36 and in so doing will activate the switches 36. Each switch 36 will then activate the control means 25 so as to return the speed of the packing machine to full speed.

Should the reservoirs 29 become completely filled, the walls 31 will activate the switches 32 so as to shut off the making machines 10.

Thus, the overall operation of the system can be made completely automatic.

It is to be noted that the control means 25 of the packing machine 12 is controlled by two series of switches 35, 36, 39. However, in order to change the operation of the packing machine 12 from full speed to half speed, only one of the switches 35 need be actuated, while, in order to change the speed of the packing machine 12 from half speed to full speed, two switches 36 must be activated.

What is claimed is:

1. The combination of a pair of cigarette making machines for making and supplying a stream of cigarettes;

a cigarette packing machine for packing cigarettes at a variable rate and having a chute to receive cigarettes;

a transfer system for delivering the cigarettes supplied from said making machines to said packing machine, said transfer system including a first horizontal conveyor extending from one of said making machines to said chute to convey a first stream of stacked cigarettes to said chute, a first storage means between said one making machine and said first conveyor for storing a variable amount of cigarettes, said first storage means including an elongated reservoir having a horizontally disposed endless conveyor belt forming a floor thereof to receive a stacked array of cigarettes thereon and a rod secured to said belt on an underside of said floor to move in a predetermined path in response to movement of said belt, a second horizontal conveyor extending from the other of said making machine to said chute and opposite said first conveyor to convey a second steam of stacked cigarettes to said chute and a second storage means between said other making machine and said second conveyor for storing a variable amount of cigarettes;

a control means for varying the packing rate of said packing machine;

a first series of switches responsive to predetermined amounts of stored cigarettes in said first storage means and being sequentially disposed in said path taken by said rod, each said switch being connected to said control means for selectively activating said control means to vary the packing rate of said packing machine in correspondence to the amount of stored cigarettes in said first storage means;

a second series of switches responsive to predetermined amounts of stored cigarettes in said second storage means, each said switch being connected to said control means for selectively activating said control means to vary the packing rate of said packing machine in correspondence to the amount of stored cigarettes in said second storage means; and a photocell connected to said first conveyor and said second conveyor and located above and in the projected plane of said chute, said photocell being responsive to the presence of cigarettes at the position thereof to deactivate said first and second conveyors and to the absence of cigarettes at said position to activate said first and second conveyors.

2. The combination as set forth in claim 1 wherein each said series of switches includes first and second switches positioned in said path of a respective rod, a first of said switches of each series being responsive to passage of a respective rod during emptying of a respective reservoir to activate said control means to operate said packing machine at a reduced speed and a second of said switches of each series being responsive to passage of a respective rod during filling of a respective reservoir to activate said control means to operate said packing machine at full speed, said second switch being disposed upstream of said first switch relative to said chute of said packing machine.

3. The combination as set forth in claim 1 wherein each series of switches includes a terminal switch positioned in said path of a respective rod downstream of said first and second switches of a respective series relative to said chute, said terminal switch being responsive to a respective rod to activate said control means to stop said packing machine when the other terminal switch is activated.

4. The combination as set forth in claim 3 wherein said photocell is connected with each said terminal switch to activate a respective conveyor only if the respective terminal switch associated with said conveyor is deactivated to allow operation of said packing machine.

5. The combination of a cigarette packing machine having a chute to receive cigarettes and a control means for operating said machine at a normal speed and a reduced speed from said normal speed;

a pair of cigarette making machines for supplying cigarettes to said packing machine;

a transfer system for delivering cigarettes from each said making machine to said packing machine, said transfer system including a first conveyor extending from a first of said making machines to said chute of said packing machine to deliver cigarettes to said packing machine, a first storage means communicating with said first making machine and said first conveyor for selectively storing cigarettes delivered from said first making machine and feeding the stored cigarettes to said first conveyor, a second conveyor extending from a second of said making machines to said chute of said packing machine to deliver cigarettes to said packing machine, and a second storage means communicating with said second making machine and said second conveyor for selectively storing cigarettes delivered from said second making machine and feeding the stored cigarettes to said second conveyor;

a first series of switches responsive to predetermined accumulations of cigarettes in said first storage means and connected to said control means of said packing machine to activate said control means to operate said packing machine at one of said operating speeds;

a second series of switches responsive to predetermined accumulations of cigarettes in said second storage means and connected to said control means of said packing machine to activate such control means to operate said packing machine at one of said operating speeds;

said first and second series of switches, each including a terminal switch responsive to an absence of cigarettes in a respective one of said first and second storage means and connected to said control means of said packing machine to activate said control means to stop said packing machine when both said terminal switches are activated; and a photocell connected with each of said terminal switches and positioned at a set position vertically above said chute to detect the absence or presence of cigarettes at the level of said position, said photocell being operatively connected to said first conveyor and said second conveyor to deactivate said conveyors in response to the presence of cigarettes at said position and to activate said conveyors at said position during operation of said packing machine, said photocells being adapted to activate a respective conveyor only if the respective terminal switch associated with said conveyor is deactivated to allow operation of said packing machine.

6. The combination as set forth in claim 5 wherein said conveyors are oppositely disposed relative to said chute of said packing machine.

7. The combination as set forth in claim 6 wherein said first storage means includes an elongated reservoir having a horizontally disposed endless conveyor belt forming a floor thereof to receive a stacked array of cigarettes thereon and a rod secured to said belt on an underside of said floor to move in a predetermined path in response to movement of said belt, and said switches of said first series of switches are sequentially disposed in said path.

8. The combination as set forth in claim 7 wherein each said series of switches includes two switches positioned in said path of a respective rod, one of said switches of each series being responsive to passage of a respective rod during emptying of a respective reservoir to activate said control means to operate said packing machine at a reduced speed and a second of said switches of each series being responsive to passage of a respective rod during filling of a respective reservoir to activate said control means to operate said packing machine at full speed, said second switch being disposed upstream of said first switch relative to said chute of said packing machine.

* * * * *